US005767431A

United States Patent [19]

Khanagov

[11] Patent Number: 5,767,431

[45] Date of Patent: Jun. 16, 1998

[54] SENSOR ASSEMBLY FOR STRINGED MUSICAL INSTRUMENTS

[75] Inventor: Villen E. Khanagov, Buena Park, Calif.

[73] Assignee: Actodyne General, Inc., Huntington Beach, Calif.

[21] Appl. No.: 580,377

[22] Filed: Dec. 28, 1995

[51] Int. Cl.[6] ..... G10H 3/18

[52] U.S. Cl. ..... 84/726

[58] Field of Search ..... 84/725–728

[56] References Cited

U.S. PATENT DOCUMENTS

| | | | |
|---|---|---|---|
| 2,078,350 | 4/1937 | Stimson . | |
| 3,742,113 | 6/1973 | Cohen | 84/726 |
| 3,992,972 | 11/1976 | Rickard . | |
| 4,010,334 | 3/1977 | Demeter . | |
| 4,050,341 | 9/1977 | Underwood . | |
| 4,069,780 | 1/1978 | Dawson . | |
| 4,145,944 | 3/1979 | Helpinstill, II . | |
| 4,184,399 | 1/1980 | Zuniga . | |
| 4,188,849 | 2/1980 | Rickard . | |
| 4,261,240 | 4/1981 | Aaroe . | |
| 4,378,722 | 4/1983 | Isakson . | |
| 4,499,809 | 2/1985 | Clevinger . | |
| 4,545,278 | 10/1985 | Gagon et al. . | |
| 4,581,974 | 4/1986 | Fender . | |
| 4,581,975 | 4/1986 | Fender . | |
| 4,809,578 | 3/1989 | Lace, Jr. | 84/726 |
| 4,869,144 | 9/1989 | Lieber . | |
| 4,872,386 | 10/1989 | Betticare . | |
| 4,885,970 | 12/1989 | Fender . | |
| 4,911,054 | 3/1990 | McClish . | |
| 4,941,389 | 7/1990 | Wendler | 84/727 |
| 5,027,691 | 7/1991 | Kennedy . | |
| 5,111,728 | 5/1992 | Blucher et al. . | |
| 5,168,117 | 12/1992 | Anderson . | |
| 5,189,241 | 2/1993 | Nakamura . | |
| 5,200,569 | 4/1993 | Moore | 84/723 |
| 5,252,777 | 10/1993 | Allen . | |
| 5,290,968 | 3/1994 | Mirigliano et al. . | |
| 5,292,998 | 3/1994 | Knapp . | |
| 5,292,999 | 3/1994 | Tumura . | |
| 5,311,806 | 5/1994 | Riboloff . | |
| 5,376,754 | 12/1994 | Stich . | |
| 5,389,731 | 2/1995 | Lace . | |
| 5,391,831 | 2/1995 | Lace . | |
| 5,391,832 | 2/1995 | Lace . | |
| 5,399,802 | 3/1995 | Blucher . | |
| 5,401,900 | 3/1995 | Lace . | |
| 5,408,043 | 4/1995 | Lace . | |
| 5,422,432 | 6/1995 | Lace . | |
| 5,430,246 | 7/1995 | Lace, Sr. et al. . | |
| 5,438,158 | 8/1995 | Riboloff . | |
| 5,464,948 | 11/1995 | Lace . | |
| 5,484,958 | 1/1996 | Ogawa | 84/731 |

*Primary Examiner*—William M. Shoop, Jr.
*Assistant Examiner*—Jeffrey W. Donels
*Attorney, Agent, or Firm*—Bliss McGlynn, P.C.

[57] ABSTRACT

A sensor assembly for a stringed musical instrument having a plurality of movable strings includes at least one magnet generating a magnetic field adjacent the strings, a primary winding creating a primary current from a disruption in the magnetic field by the strings, the primary current creating a primary electromagnetic flux, at least one secondary winding spaced from the primary winding and transforming the primary electromagnetic flux into a secondary current which is passed out of the stringed musical instrument.

20 Claims, 2 Drawing Sheets

SENSOR ASSEMBLY FOR STRINGED MUSICAL INSTRUMENTS

BACKGROUND OF THE INVENTION

1. Field of the Invention

The present invention relates generally to musical instruments and, more particularly, to a sensor assembly for use with stringed musical instruments.

2. Description of the Related Art

Generally, stringed musical instruments such as electric guitars have electromagnetic sensors or pick-ups for sensing mechanical vibrations of strings and converting such vibrations into electrical signals. These electrical signals from the electromagnetic sensors are amplified, modified and, ultimately, reconverted into acoustical energy for producing music and the like.

An example of such an electromagnetic sensor is disclosed in U.S. Pat. No. 4,809,578, issued Mar. 7, 1989, entitled "Magnetic Field Shaping in an Acoustic Pick-up Assembly." This patented sensor assembly includes an elongated ferromagnetic case lined on the interior thereof with planar permanent magnet pieces to present the same magnetic polarity into the interior thereof. The patented sensor assembly also includes cores disposed in the interior of the case and having a plurality of co-planar, spaced, finger-like projections directed at the walls of the case. The walls and projections are permanently magnetized to a common magnetic polarity which will concentrate magnetic flux into gaps between the projections. The patented sensor assembly further includes a coil wound around the cores wherein the flux changes of these concentrated flux fields due to the movement or vibration of the strings induces a voltage in the coil. The coil has terminals connected to a socket in the stringed musical instrument for connection to an amplifier and speaker system.

Although the above patented sensor assembly has worked well, it is typically more expensive to manufacture and assemble than conventional pick-ups. Moreover, Musicians who play stringed musical instruments are desirous of having sensors which incorporate greater sensitivity of the full range of the acoustic energy generated by the movement of such strings with less sensitivity to surrounding environmental magnetic fields, such as 60 Hz, than conventional pick-ups. Thus, there is a need in the art to provide a sensor assembly which has greater sensitivity than conventional pick-ups and is less expensive to manufacture and assemble than the patented sensor assemblies.

SUMMARY OF THE INVENTION

It is, therefore, one object of the present invention to provide a sensor assembly for a stringed musical instrument.

It is another object of the present invention to provide a sensor assembly which incorporates greater sensitivity to string movement with less sensitivity to surrounding environmental magnetic fields.

It is yet another object of the present invention to provide a sensor assembly which has greater sensitivity to string movement which is less expensive to manufacture and assemble than current patented sensor assemblies.

To achieve the forgoing objects, the present invention is a sensor assembly for a stringed musical instrument having a plurality of movable strings. The sensor assembly includes at least one magnet generating a magnetic field adjacent the strings and a primary winding creating a primary current from a disruption in the magnetic field by the moveable strings. The primary current creates a primary electromagnetic flux. The sensor assembly also includes at least one secondary winding spaced from the primary winding. The primary winding is magnetically coupled to the secondary windings by high magnetic permeability metal laminate core elements. The secondary winding transforms the primary electromagnetic flux into a secondary current which is passed out the stringed musical instrument.

One advantage of the present invention is that a sensor assembly is provided for a stringed musical instrument having low impedance reception and high impedance output. Another advantage of the present invention is that the sensor assembly provides a greater signal to noise ratio than conventional pick-ups. Yet another advantage of the present invention is that the sensor assembly provides greater sensitivity and clearer sound over a larger range of frequencies than conventional pick-ups. Still another advantage of the present invention is that the sensor assembly is smaller in physical size and less expensive to manufacture and assemble than current patented sensor assemblies. A further another advantage of the present invention is the sensor assembly has the ability to achieve different and broader ranges of tones than conventional pick-ups. Yet a further advantage of the present invention is that the sensor assembly has a higher output signal and is less sensitive to surrounding magnetic interference than conventional pick-ups. Still a further advantage of the present invention is that the sensor assembly has the ability to be tailored to almost any output impedance and has an immunity to microphonics. Another advantage of the present invention is that the sensor assembly has a low output resistance which provides a better operating condition for standard musical instrument circuits (e.g., amps, speakers, etc.).

Other objects, features and advantages of the present invention will be readily appreciated as the same becomes better understood after reading this subsequent description taken in conjunction with the accompanying drawings.

DESCRIPTION OF THE PREFERRED EMBODIMENT(S)

Figure 1:
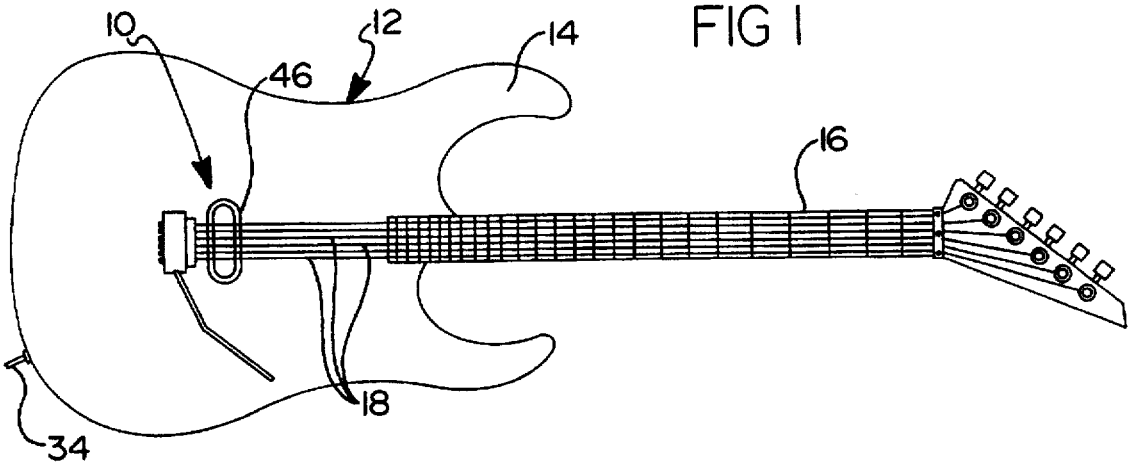
FIG. 1 is a plan view of a sensor assembly, according to the present invention, illustrated in operational relationship to a stringed musical instrument.
Figure 2:
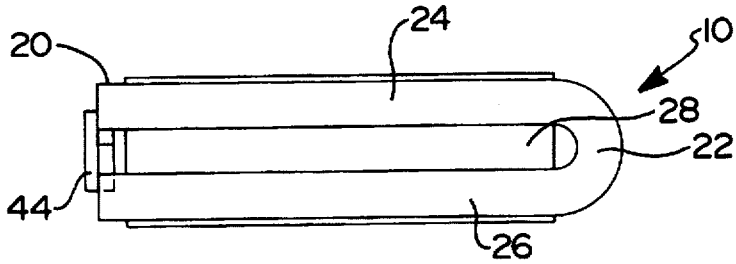
FIG. 2 is an enlarged view of the sensor assembly of FIG. 1 with a cover removed.
Figure 3:
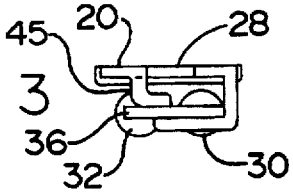
FIG. 3 is an end view of the sensor assembly of FIG. 2.
Figure 4:
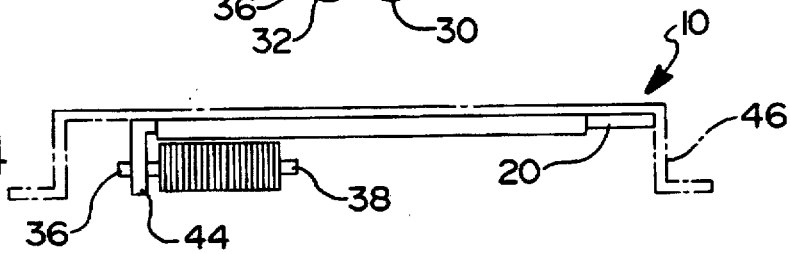
FIG. 4 is an elevational view of the sensor assembly of FIG. 1 with a cover shown in phantom.
Figure 5:
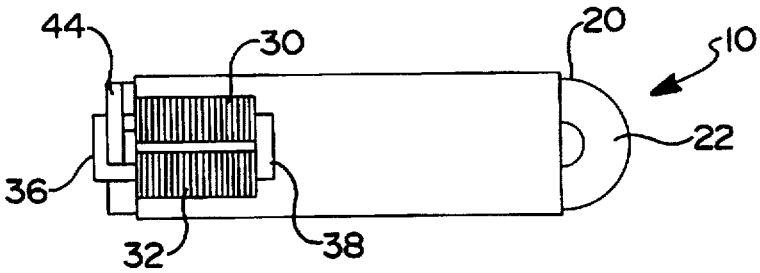
FIG. 5 is a bottom view of the sensor assembly of FIG. 2.
Figure 8:
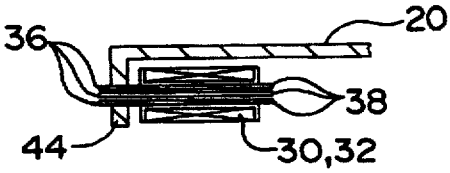
FIG. 8 is a fragmentary elevational view of a portion of the sensor assembly of FIG. 1.
Figure 6:
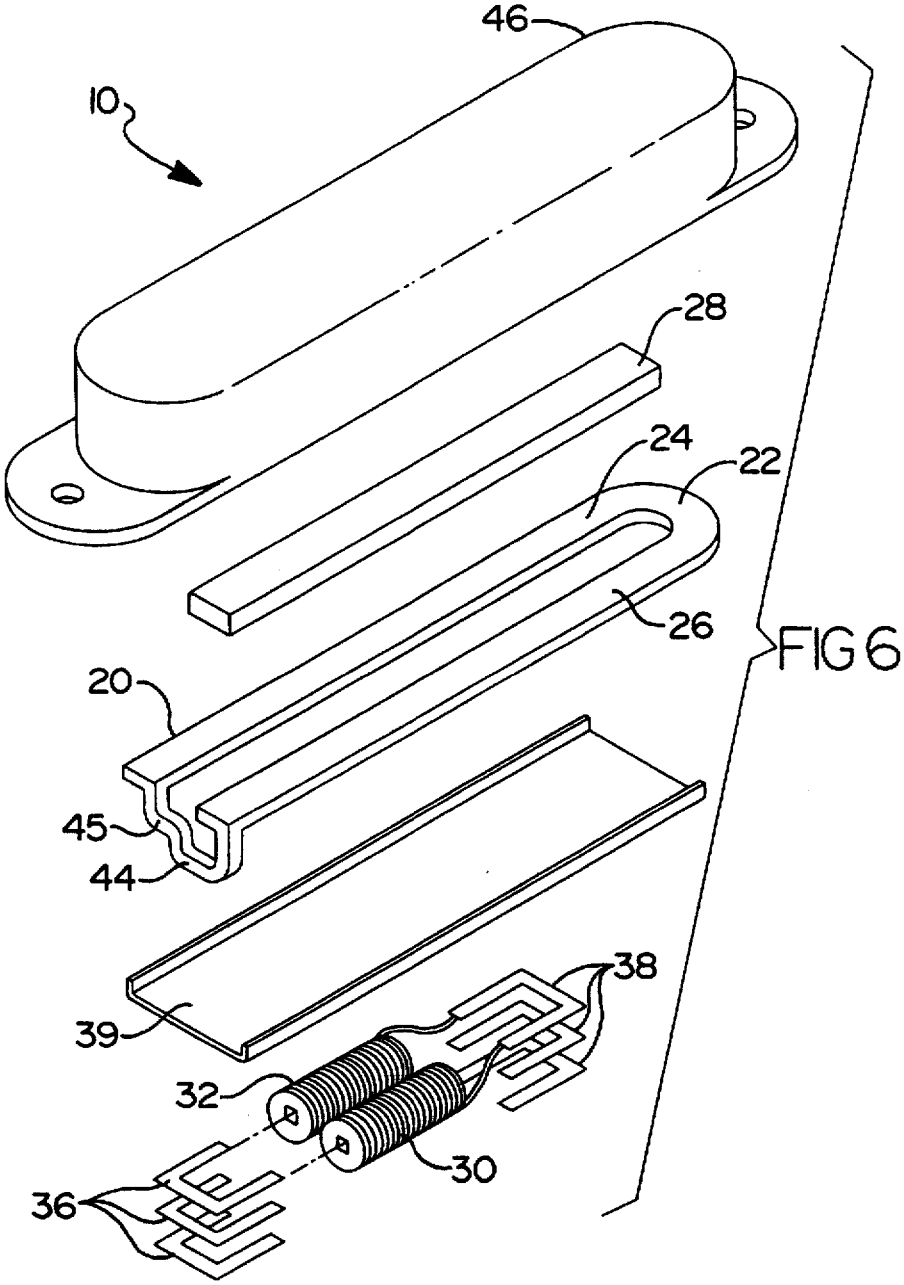
FIG. 6 is an exploded perspective view of the sensor assembly of FIG. 1.

Referring to the drawings and in particular to FIG. 1, one embodiment of a sensor assembly 10, according to the present invention, is illustrated in operational relationship with a stringed musical instrument such as a guitar, generally indicated at 12. The guitar 12 is of the electric type and has a body portion 14, a neck portion 16, and a plurality of movable strings 18. The movable strings 18 are secured at one end to the body portion 14 and extend along the body portion 14 and the neck portion 16 where they are adjustably secured at the other end to the neck portion 16. The sensor assembly 10 is disposed beneath the movable strings 18 and mounted to the body portion 14 as will be described. It should be appreciated that the sensor assembly 10 may be configured to act as a humbucker or a noise compensating single coil.

Referring to FIGS. 2 through 6, the sensor assembly 10 includes a primary winding 20 made from a conductive material. Preferably, the primary winding 20 is made of a conductive material such as copper. The primary winding 20 is preferably a solid piece of copper made as a single layer stamping or multilaminate construction. It should be appreciated that the primary winding 20 may be made of any suitable conductive material.

The primary winding 20 includes at least one generally arcuate bend 22 out of which first and second arms 24 and 26 extend longitudinally to form a generally U-shaped configuration. This configuration acts as a one turn receiver. In one embodiment, the first arm 24 and the second arm 26 are generally parallel and have a predetermined length and are equal in length. Preferably, the arms 24,26 extend to encompass all of the moveable strings 18. It should be appreciated that the primary winding 20 may be configured to have other suitable shapes than the U-shape. It should also be appreciated that the primary winding 20 may be a plurality of windings.

The sensor assembly 10 includes at least one permanent magnet 28 extending longitudinally along the predetermined length and disposed between the first arm 24 and second arm 26 of the primary winding 20. The permanent magnet 28 is substantially rectangular in shape and is made of a magnetic material. It should be appreciated that the permanent magnet 28 may have a variety of shapes and configurations or materials. It should be appreciated that the primary winding 20 may be wound around a single or a plurality of permanent magnets 28. It should also be appreciated that, if more than one permanent 28 magnet is used, the primary winding(s) around each of the permanent magnets may be connected in parallel or series.

The sensor assembly 10 also includes at least one secondary winding 30 spaced from the primary winding 20. The secondary winding 30 extends adjacent to the primary winding 20. In one embodiment, a second secondary winding 32 extends parallel to both the primary winding 20 and a first secondary winding 30. The first secondary winding 30 and the second secondary winding 32 will hereinafter be referred to as the secondary windings 30, 32. The secondary windings 30, 32 are disposed between the body portion 14 and the primary winding 20. The secondary windings 30,32 are coils of a conductive wire such as copper wrapped around core elements 36,38 to be described. It should be appreciated that the secondary windings 30,32 can be either single or multiple coils connected in series or parallel.

The secondary windings 30, 32 are susceptible to electromagnetic flux transferred by the core elements 36,38 to be described from the primary winding 20. The secondary windings 30, 32 transform the primary electromagnetic flux into a secondary current. More specifically, the primary winding 20 and the secondary windings 30,32 and the core elements 36,38 act together as a transformer which transforms the primary current into the secondary current. The secondary current is passed through an output port 34 to electronics subsequent to the sensor assembly 10. Although the primary winding 20 is shown to be a separate circuit than that of the secondary windings 30,32, the secondary windings 30,32 may in an alternative embodiment (not shown) be connected in series to the primary winding 20 at a common point to create an autotransformer. It should be appreciated that possible electronic components which may be operatively connected to the output port 34 include receivers, synthesizers, amplifiers, speakers, and the like.

The secondary windings 30,32 extend a distance shorter than the predetermined length of the first arm 24 and the second arm 26. The secondary windings 30,32 include a first core element 36 which extends through one end of the secondary windings 30,32 and a second core element 38 which extends through the other end of the secondary windings 30,32. In one embodiment, the first and second core elements 36,38, which are "U" shaped in appearance, extend into the secondary windings 30, 32 from each end and telescopingly engage. The core elements 36,38 are made from laminations of a high permeable magnetic material such as steel. In another embodiment, the first core element 36 and second core element 38 may have portions extending out and around the secondary windings 30,32. In that embodiment, the first core element 36 and second core element 38 have a general "E" shape and telescopingly engage together.

The sensor assembly 10 also includes a magnetic field barrier 39 extending longitudinally. The magnetic field barrier 39 has a generally U-shaped cross-sectional shape. The magnetic field barrier 39 is disposed about a portion of the primary winding 20 and between the secondary windings 30,32 and the primary winding 20. The magnetic field barrier 39 shields at least a portion of the secondary windings 30,32 to minimize the sensitivity thereof to extraneous environmental electromagnetic flux, i.e., electromagnetic flux created by other pieces of electrical equipment.

The primary winding 20 includes a bracket 44 having a generally U-shaped and descending perpendicularly from the primary winding 20 to complete the circuit created by the primary winding 20. The bracket 44 has a generally "L" shaped portion 45 on one arm thereof. The bracket 44 is made of a conductive material such as copper and is formed as integral and one-piece with the primary winding 20. The first core element 36 is disposed about the bracket 44 below the L shaped portion 45 in spaced relation to the primary winding 20. The bracket 44 contacts both the primary winding 20 and the core elements 36,38 of the secondary windings 30, 32. It should be appreciated that a bracket 44 acts as a one turn transformer primary winding.

The sensor assembly 10 further includes a cover 46 enclosing the sensor assembly 10. In one embodiment, the cover 46 fully encloses all of the internal components of the sensor assembly 10. The cover 46 is fabricated from a material which does not affect the magnetic fields created by the permanent magnet 28 or the vibrations created by the motion of the movable strings 18. The cover 46 is secured to the body portion 14 by suitable means such as fasteners (not shown).

Figure 7:
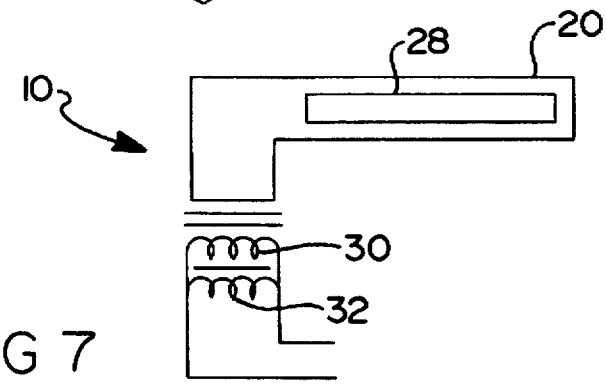
FIG. 7 is an electrical schematic diagram of the sensor assembly of FIG. 1.

Referring to FIG. 7, an electrical schematic diagram of the sensor assembly 10 is illustrated wherein the primary winding 20 is shown in relation to the secondary windings 30, 32. The permanent magnet 28 and the magnetic field barrier 39 create a permanent magnetic flux or field adjacent the moveable strings 18. Movement of the moveable strings 18 will disturb or alter the magnetic field and create a primary current in the primary winding 20. The primary current will circulate in the primary winding 20 and bracket 44 because it is a complete electrical circuit and creates a primary electromagnetic flux. The secondary winding 30,32 is coupled with the primary winding 20 via the core elements 36,38. The sensor assembly 10 acts as a transformer and the secondary windings 30,32 transform the primary electromagnetic flux into a secondary current which is passed out of the output port 34. This transformer has a primary low impedance side as the receiver for ferromagnetic object vibrations and a secondary high impedance side for the output. It should be appreciated that the ratio of impedances may be chosen to create a desired output impedance.

The present invention has been described in an illustrative manner. It is to be understood that the terminology which has been used is intended to be in the nature of words of description rather than of limitation.

Many modifications and variations of the present invention are possible in light of the above teachings. Therefore, within the scope of the appended claims, the present invention may be practiced otherwise than as specifically described.

What is claimed is:

1. A sensor assembly for a stringed musical instrument having a plurality of movable strings comprising:

at least one magnet generating a magnetic field adjacent the strings;

a primary winding creating a primary current from a disruption in the magnetic field by the strings, the primary current creating a primary electromagnetic flux;

at least one secondary winding spaced from said primary winding; and at least one core element operatively connecting said at least one secondary winding to said primary winding, said sensor assembly being disposed beneath the strings and acting as a transformer, whereby said at least one secondary winding transforms, the primary electromagnetic flux into a secondary current which is passed out of the stringed musical instrument.

2. A sensor assembly as set forth in claim 1 wherein said at least one magnet is a permanent magnet disposed adjacent said primary winding.

3. A sensor assembly as set forth in claim 1 wherein said primary winding is made of a conductive material.

4. A sensor assembly as set forth in claim 1 including a plurality of secondary windings disposed adjacent said primary winding.

5. A sensor assembly as set forth in claim 1 wherein said at least one secondary winding includes a core element extending parallel to said primary winding.

6. A sensor assembly as set forth in claim 1 wherein said primary winding has at least one bend therein.

7. A sensor assembly as set forth in claim 1 including a magnetic field barrier disposed about a portion of said primary winding and between said at least one secondary winding and said primary winding.

8. A sensor assembly for a stringed musical instrument having a plurality of movable strings comprising:

at least one magnet generating a magnetic field adjacent the strings;

a primary winding creating a primary current from a disruption in the magnetic field by the strings, the primary current creating a primary electromagnetic flux;

at least one secondary winding spaced from said primary winding and transforming the primary electromagnetic flux into a secondary current which is passed out of the stringed musical instrument;

said primary winding having at least one bend therein; and said primary winding including first and second arms extending out from said at least one bend such that said first arm and said second arm are parallel.

9. A sensor assembly as set forth in claim 8 wherein said first arm and said second arm extend past said secondary windings.

10. A sensor assembly as set forth in claim 9 wherein said at least one magnet extends between said first arm and said second arm.

11. A sensor assembly for a stringed musical instrument having a plurality of movable strings comprising:

at least one magnet generating a magnetic field adjacent the strings;

a primary winding creating a primary current from a disruption in the magnetic field by the strings, the primary current creating a primary electromagnetic flux;

at least one secondary winding spaced from said primary winding and transforming the primary electromagnetic flux into a secondary current which is passed out of the stringed musical instrument;

wherein said primary winding has a U-shaped configuration.

12. A sensor assembly for a stringed musical instrument having a plurality of movable strings comprising:

at least one magnet generating a magnetic field adjacent the strings;

a primary winding creating a primary current from a disruption in the magnetic field by the strings, the primary current creating a primary electromagnetic flux;

at least one secondary winding spaced from said primary winding and transforming the primary electromagnetic flux into a secondary current which is passed out of the stringed musical instrument; and a bracket descending perpendicularly from one end of said primary winding.

13. A sensor assembly as set forth in claim 12 wherein said bracket is U-shaped.

14. A sensor assembly for a stringed musical instrument having a plurality of movable strings comprising:

at least one magnet generating a magnetic field adjacent the strings;

a primary winding creating a primary current from a disruption in the magnetic field by the strings, the primary current creating a primary electromagnetic flux;

a bracket descending perpendicularly from said primary winding; and a plurality of secondary windings secured to said bracket and extending outwardly therefrom and spaced apart from said primary winding, said secondary winding transforming said primary electromagnetic flux into a secondary current which is passed out of the stringed musical instrument.

15. A sensor assembly as set forth in claim 14 wherein each of said secondary windings include a core element extending parallel to said primary winding.

16. A sensor assembly as set forth in claim 14 wherein said primary winding includes at least one bend therein.

17. A sensor assembly as set forth in claim 16 wherein said primary winding includes first and second arms extending outwardly from said bend such that said first arm and said second arm are parallel.

18. A sensor assembly as set forth in claim 17 wherein said first arm and said second arm extend outwardly past said secondary windings.

19. A sensor assembly as set forth in claim 18 wherein said at least one magnet extends between said first arm and said second arm.

20. A sensor assembly for a stringed musical instrument having a plurality of movable strings, said sensor assembly comprising:

a primary winding;

at least one secondary winding;

at least one permanent magnet being disposed adjacent said primary winding;

a bracket extending from said primary winding; and at least one core element for attaching said at least one secondary winding to said bracket and in spaced relation to said primary winding.

* * * * *